United States Patent [19]

Stevens (Boyer)

[11] 4,005,502

[45] Feb. 1, 1977

[54] ELECTRIC POWER SCRUBBER

[76] Inventor: Elaine Stevens (Boyer), 2750 Endicott Road, Shaker Heights, Ohio 44120

[22] Filed: Sept. 25, 1975

[21] Appl. No.: 616,557

[52] U.S. Cl. ..... 15/22 R

[51] Int. Cl.[2] ..... A46B 13/02

[58] Field of Search ..... 15/22 R, 22 A, 22 C, 15/49 RB, 50 A, 97 R; 128/46, 49; 51/170 R, 170 MT, 170 TL

[56] References Cited

UNITED STATES PATENTS

| | | | |
|---|---|---|---|
| 1,018,927 | 2/1912 | Sarrazin | 15/167 R |
| 3,160,995 | 12/1964 | Danuski, Jr. | 51/170 TL |
| 3,231,917 | 2/1966 | Reed | 15/22 R X |
| 3,588,936 | 6/1971 | Duve | 15/22 R |

*Primary Examiner*—Edward L. Roberts

[57] ABSTRACT

An electrically powered hand-held scrubber is disclosed which comprises a scrubbing brush removably attached to a sealed housing having a configuration adapted for a hand grip. Within the housing is a motor, preferably powered by rechargeable nickel cadmium storage cells which drives an eccentric. The eccentric produces an oscillating rotary motion which is communicated to the brush. The brush is moved in an oscillating back-and-forth rotary motion rather than a constant rotary motion, resulting in a more effective cleansing action. The brush has a generally triangular shape enabling it to fit into corners and other tight spots into which a circular brush cannot fit.

7 Claims, 7 Drawing Figures

FIG. 6
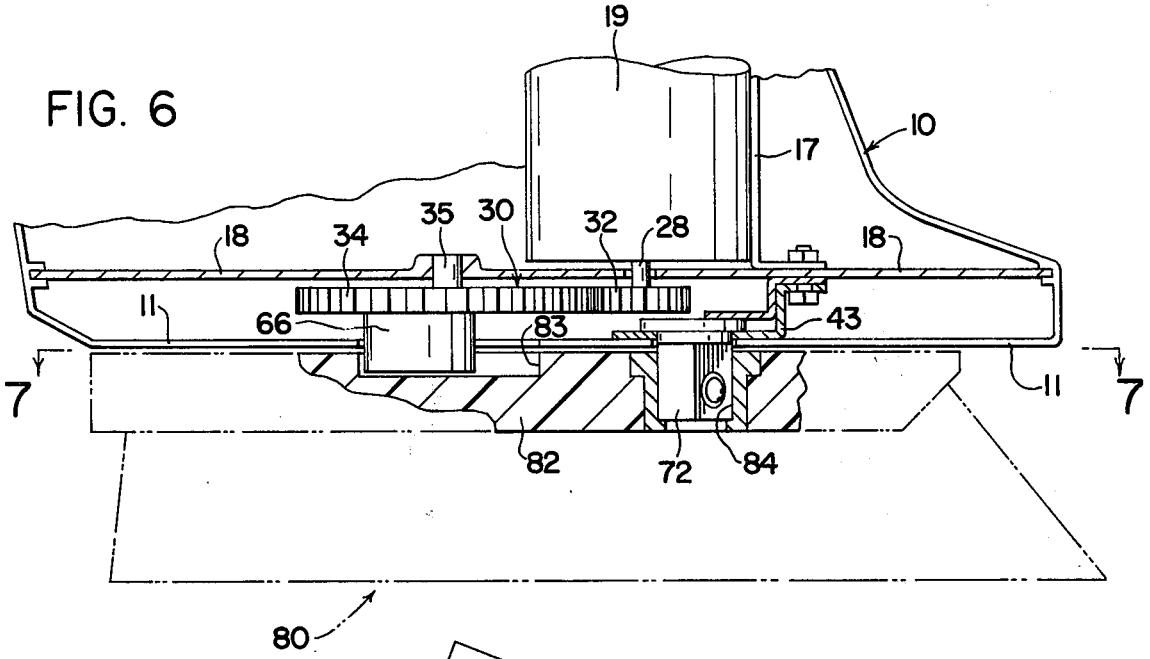
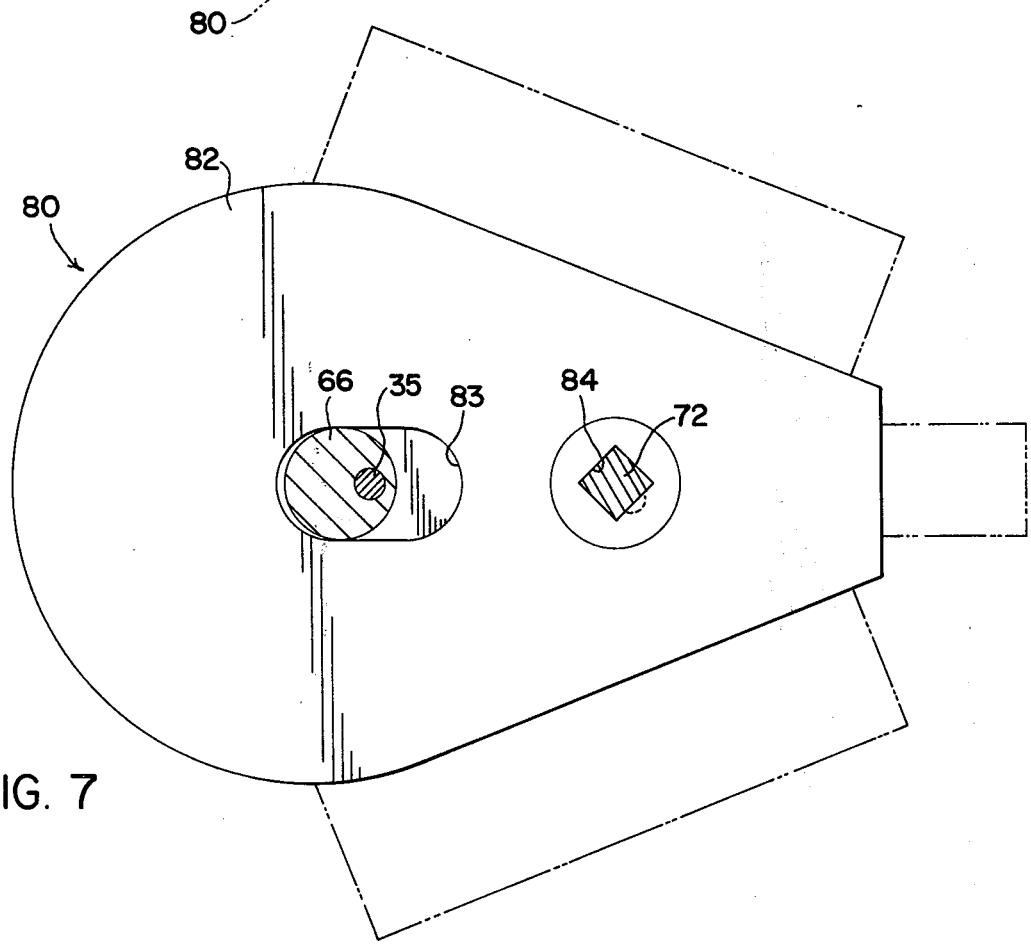
FIG. 7

ELECTRIC POWER SCRUBBER

BACKGROUND OF THE INVENTION

This invention relates to brushing, scrubbing and general cleaning, and specifically to a hand-held machine for power scrubbing.

To replace tedious manual scrubbing which is common in household cleaning, several forms of power scrubbers have been developed. These power scrubbers have had electric motors within sturdy housings to rotate a scrubbing brush mounted on the shaft of the motor. In some cases the motors have been battery-powered, enabling the scrubber to be used anywhere without a bothersome cord. The rotary brushes usually have had a generally circular shape.

Although these previous scrubbers have been small, lightweight and easily handled, they have had many disadvantages. The rotary scrubbing motion is not as effective as the traditional manual scrubbing motion. A person manually scrubbing a surface uses a back-and-forth movement which is not effectively simulated by the rotary motion of prior art scrubbers. Also, the circular brush of these previous scrubbers cannot fit into corners or other tight spots. Thus, the user was forced to rely on manual scrubbing to finish the job.

SUMMARY OF THE INVENTION

The scrubber of the present invention overcomes the disadvantages of the prior art by providing a hand-held electrically powered scrubber which simulates the back-and-forth movement of manual scrubbing and which has a triangular brush which fits into corners.

It is an object of the present invention to provide an improved electrically powered hand-held scrubber.

Another object is to provide a scrubber which produces a reversing back-and-forth movement which breaks through the dirt surface quicker than a constant rotary motion.

Still another object is to provide an electric power scrubber which has a generally triangular-shaped brush capable of fitting easily into corners and other tight spots into which a conventional circular brush cannot fit.

Yet another object is to provide a power scrubber which can thoroughly clean irregular shapes and texturized surfaces.

Another object is to provide a power scrubber which produces a concentrated cleaning motion, enabling the scrubber to be used in cramped areas such as the bottom of garbage cans and wastebaskets.

Another object is to provide a lightweight all-purpose hand-held power scrubber which can be used dry to dust or used wet with cleansers to scrub.

Another object is to provide an electrically powered scrubber which has a hand grip and an oscillatory back-and-forth motion which simulates as closely as possible the user's established habits of cleaning.

Another object is to provide an electrically powered scrubber which can receive an interchangeable variety of attachments best suited to different cleaning tasks.

These and other objects are accomplished by the scrubber according to the present invention in which a generally triangular-shaped brush is attached to a sealed housing which has a configuration to be easily gripped by hand. Within the housing is an electric motor which drives an eccentric. Around the eccentric is a yoke formed around a hole in a plate. The plate turns an attached oscillatory shaft in a reciprocating rotary back-and-forth motion. The generally triangular-shaped brush is removably mounted on the oscillatory shaft. Alternatively, the yoke can be formed around a hole in the body of the brush so that the wheel oscillates the brush when the brush is mounted on the shaft.

Preferably, the motor is powered by a rechargeable battery contained in the housing, enabling the scrubber to be used anywhere without the restriction of an electric cord. Also, a switch is preferably provided on the handle of the housing to enable the user to turn the scrubber on and off easily. The preferred embodiment of the present scrubber can be provided with a variety of different brushes. Depending upon the type of cleaning or dusting to be accomplished, the proper brush can be removably mounted on the oscillating shaft.

BRIEF DESCRIPTION OF THE DRAWINGS

FIG. 6 is a sectional view similar to FIG. 3 showing an alternative embodiment of the scrubber of the present invention; and FIG. 7 is a plan view of the brush mount taken along the line 7—7 of FIG. 6.

DESCRIPTION OF THE PREFERRED EMBODIMENT

Figure 1:
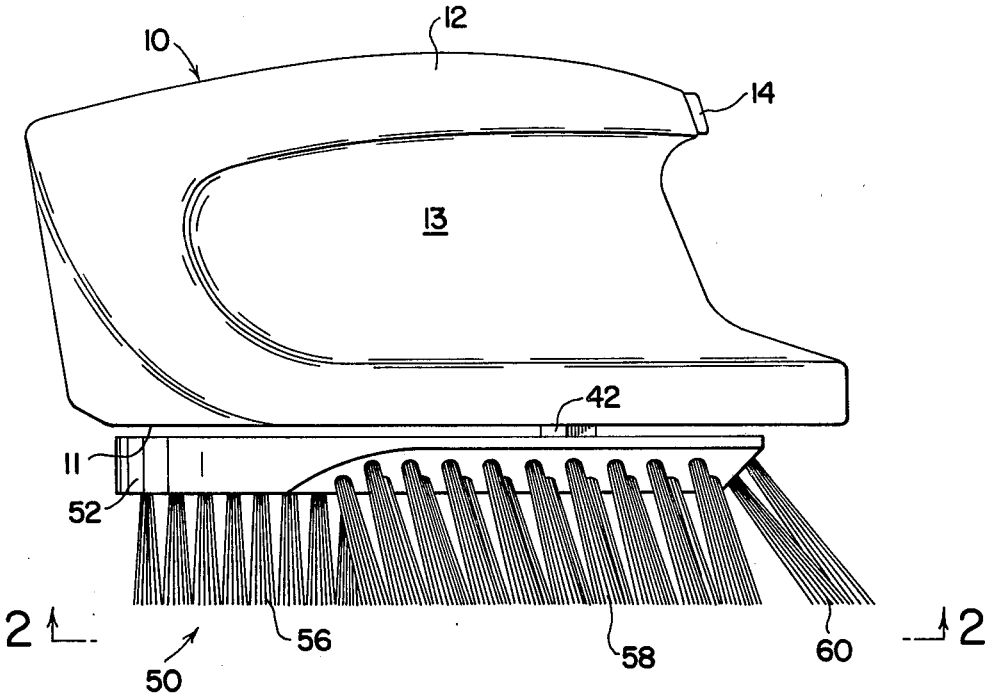
FIG. 1 is a side elevational view of the scrubber of the present invention.

Referring more particularly to the drawings and initially to FIG. 1, there is shown an electric power scrubber according to the present invention having a sealed housing 10. The housing 10 is sealed to be as waterproof as possible to protect the power means inside against damage from water associated with scrubbing tasks. Preferably, the housing 10 is made from a sturdy molded plastic material such as ABS polymers, acetal copolymers and homopolymers, high density polyethylenes and the like. The housing 10 has a generally flat bottom 11 and an upper portion designed to be easily gripped by hand. The upper portion of the housing 10 includes a handle portion 12 and a recessed portion 13, which together provide a comfortable hand-grip shape. The hand-grip configuration allows the user of the scrubber to grip the scrubber in the same way that the user would grip a sponge, rag or ordinary scrub brush. Protruding from the forward end of the handle portion 12 is a switch button 14. By pushing in the switch button 14, the user can start and stop the power means within the housing.

Figure 3:
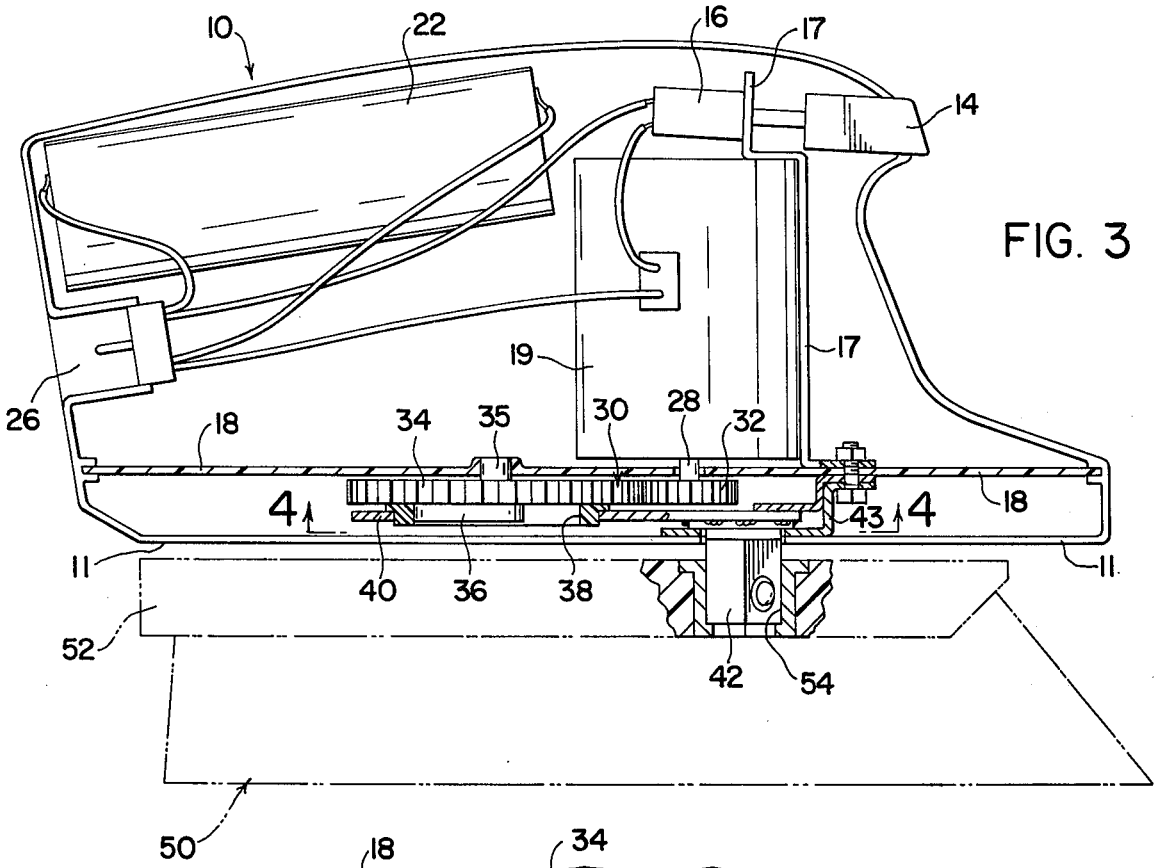
FIG. 3 is a sectional view of the scrubber interior taken along the line 3—3 of FIG. 2.
Figure 4:
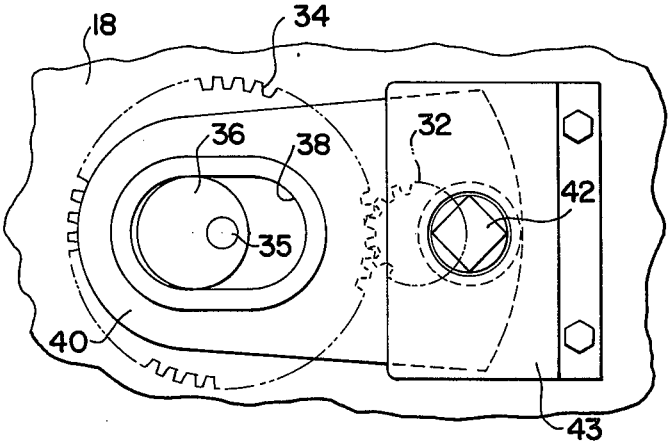
FIG. 4 is a bottom view of the oscillating mechanism of the scrubber taken along the line 4—4 of FIG. 3.

As shown in FIG. 3, the button 14 is operatively connected to a switch 16 mounted on a bracket 17 which is secured to a mounting plate 18. The switch 16 is connected to the power means of the scrubber which includes a motor 19 mounted on the bracket 17. The motor 19 is a conventional electric small-appliance or power-tool motor having adequate power to drive the scrub brush when pressed against a dirty surface. A variable-speed motor may be used, in which case the switch 16 may be a speed control switch. The motor 19 is connected to a supply of electric power. Preferably, the electric power supply comprises nickel cadmium storage cells 22 mounted within the housing 10. While electric power could also be supplied from an ordinary electric outlet via a plugged-in cord, the storage cells 22 allow the scrubber to be used anywhere without the restrictions of a cord. A nickel cadmium battery, or other rechargeable battery, is preferred so that the scrubber can be easily recharged from ordinary house current when not in use and the expense of replaceable batteries is avoided. The rechargeable battery 22 is connected to a socket 26 into which a plug can be inserted when the scrubber is not in use, enabling the battery 22 to be recharged. The rechargeable batteries may also be designed as a unit that could be slipped in and out of the scrubber and charged separately.

A rotating shaft 28 emerges from the motor 19 and provides the motor power to the oscillating means below. Preferably, a reduction gearing means 30 is provided to reduce the speed of the oscillating brush from that of the rotating motor and to increase the power of the oscillating brush. The slower, more powerful oscillating movement is preferred since it allows the user to apply greater pressure to the scrubbed surface without stalling the motor and without excessive reaction forces produced by higher oscillating speeds. The gearing means 30 comprises a gear 32 mounted on the shaft 28 and a larger gear 34 mounted on a shaft 35 driven thereby. Preferably, the gears 32 and 34 are made from nylon such as nylon 66 or an equivalent material.

Mounted on the shaft 35 coaxially with the larger gear 34 is a cam or eccentric 36. The eccentric 36 fits within a yoke 38 formed around a hole in a plate 40. The yoke 38 is preferably made from acetal homopolymer (Delrin) or an equivalent material. The plate 40 is parallel to and just above the housing bottom 11. Attached to the plate 40 is a shaft 42 which is pivotally mounted through a flange 43 attached to the mounting plate 18. The shaft 42 provides a pivot for the movement of the plate 40.

Figure 5:
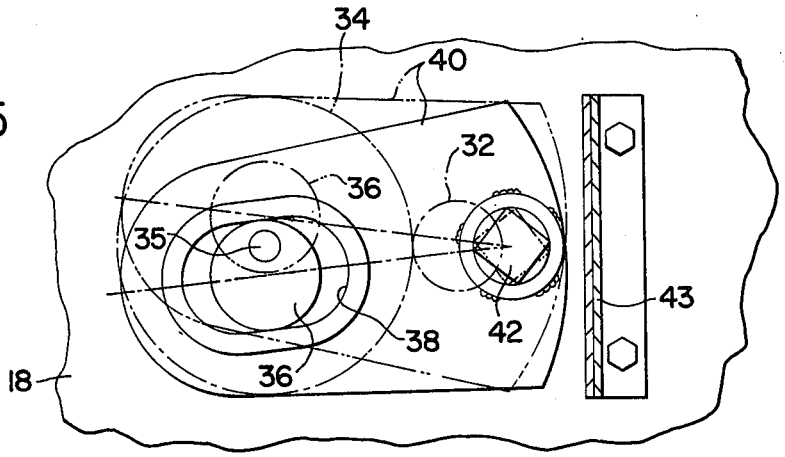
FIG. 5 is another view of the mechanism of FIG. 4 showing the oscillation motion in broken and solid lines.

The movement of the oscillating means can be seen by comparing the solid and broken lines of FIG. 5. As the smaller gear 32 rotates the larger gear 34, it turns the eccentric 36. The yoke 38 around the eccentric 36 oscillates, swinging the plate 40 in an arcuate to-and-fro oscillatory motion. At the shaft 42, the motion becomes a purely oscillating rotary motion in which the shaft 42 rotates back-and-forth in a reciprocatory or oscillatory manner. By this means the rotary motion of the motor shaft 28 is converted into the oscillating motion of the shaft 42.

Figure 2:
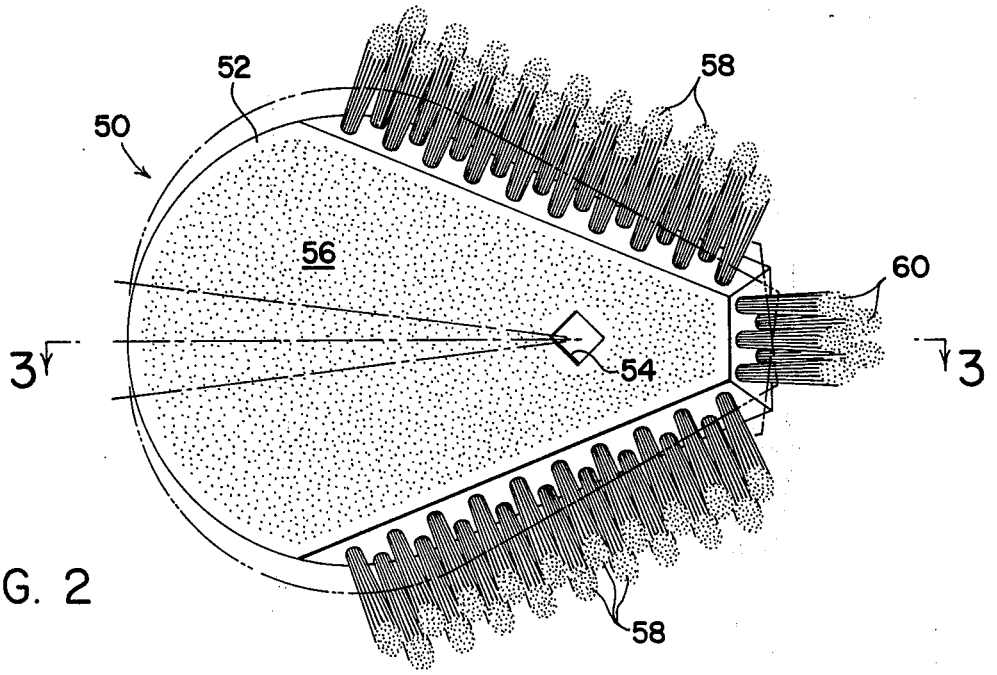
FIG. 2 is a bottom view taken along the line 2—2 of FIG. 1 showing a preferred scrubbing brush.

The shaft 42 extends through an opening in the bottom 11 of the housing. Mounted on the shaft 42 is any one of a number of different preferred scrubbing brushes, such as a brush 50 shown in FIG. 2. The brush 50 has a generally triangular-shaped body 52 which has a hole 54 for mounting the brush on the oscillatory shaft 42. Attached to the body 52 is an inner set of bristles 56 having a generally triangular shape. Surrounding the inner bristles is a periphery of outer bristles which includes two sets of bristles 58 on each side of the brush and a forward set of bristles 60 on the nose of the brush. Each set of outer bristles 58 and 60 are mounted to the brush body 52 to extend outwardly at an angle. The outer bristles 58 and 60 enable the user to clean corners and crevices easily while the inner bristles 56 provide ability to scrub flat surfaces. Thus, the brush 50 is able to clean irregular shapes and texturized surfaces.

Alternative brushes includes those in which the inner bristles 56 are replaced by a scrub pad material (nylon with abrasive filler), such as Scotchbrite, or a sponge material or a dusting or polishing material. In addition, the inner or outer bristles may be made to any desired length or stiffness.

An alternative embodiment of the scrubber of the present invention is shown in FIGS. 6 and 7. In this embodiment the yoke 38 and the plate 40 of the previous embodiment are combined with the body 52 of the brush. The housing 10 of the scrubber has the same general configuration with an internal battery and a motor 19. A reduction gearing means 30 comprising a gear 32 on the motor shaft 28 and a larger gear 34 on the shaft 35 is provided as before.

A cam or eccentric 66 is mounted coaxially with larger gear 34 on the shaft 35. Unlike the previous embodiment, the eccentric 66 extends below the bottom 11 of the housing of the scrubber. Also extending below the housing bottom 11 is a shaft 72. The shaft 72 is pivotally mounted through the flange 43 attached to the mounting plate 18. A brush 80 is mounted on the shaft 72. The body 82 of the brush has an opening around which is formed a yoke 83 to fit over the eccentric 66. The body 82 of the brush also has a hole 84 for mounting the brush on the shaft 72. As the eccentric 66 turns, it oscillates the brush back-and-forth in an arcuate manner about the pivot formed by the shaft 72. This scrubber produces the same general movement as the scrubber of the previous embodiment, but the yoke 38 and the plate 40 have been combined with the body 52 of the brush in a single element.

The principal advantage of this form of the invention is that the configuration of the yoke opening 83 can be modified from brush to brush and thus provide varying amplitudes and speeds of oscillation by merely changing brushes. A longer yoke opening provides a larger, slower oscillation and a shorter one a smaller, faster oscillation. No other changes or adjustments are required to achieve this effect.

The scrubber of the present invention can also be provided with a storage stand having a built-in recharger which can be conveniently mounted in a kitchen near the sink. When the scrubber is mounted in the stand, the socket 26 is mounted in a plug in the storage stand which is directly connected to a recharger current. Through this means the batteries 22 are recharged whenever the scrubber is stored in the stand, enabling it to always be ready for use.

While the invention has been shown and described with respect to specific embodiments thereof, these are intended for the purpose of illustration rather than limitation. Other modifications and variations in the specific scrubber herein shown and described will be apparent to those skilled in the art, all within the intended scope and spirit of the invention. Accordingly, the invention is not to be limited to the specific embodiment herein shown and described nor in any other way that is inconsistent with the extent to which the progress in the art has been advanced by this invention.

I claim:

1. A power scrubber, which comprises:

a sealed housing;

a motor mounted within the housing having a rotary shaft;

an oscillatory shaft pivotally mounted in the housing, the oscillatory shaft extending from the housing and capable of revolving back and forth in an oscillatory manner;

a generally triangular-shaped brush body mounted on the oscillatory shaft, the brush body having a periphery of outwardly extending angularly disposed bristles about a generally triangularly shaped center of material extending from one side of said brush body and being capable of oscillating pivotally about the revolving oscillatory shaft axis, the said axis extending through said center material; and means for oscillating the brush body about the oscillatory shaft axis which includes an eccentric rotatably mounted within the housing and rotated by the rotary shaft and a yoke fitting around the eccentric and producing an oscillatory motion as the eccentric rotates.

2. A scrubber according to claim 1 wherein said generally trianglularly shaped center of material is a set of bristles.

3. A scrubber according to claim 1 comprising in addition a rechargeable battery mounted within the housing operatively connected to the motor to supply power thereto.

4. A power scrubber, which comprises:

a sealed housing;

a motor mounted within the housing having a rotary shaft;

an eccentric rotatably mounted within the housing, which is rotated by the rotary shaft;

an oscillatory shaft pivotally mounted in the housing, the oscillatory shaft extending from the housing and capable of revolving back and forth in an oscillatory manner;

a generally triangular-shaped brush mounted on the oscillatory shaft capable of oscillating pivotally about the revolving oscillatory shaft axis; and a plate mounted within the housing, said plate having an opening therein forming a yoke which fits around the eccentric and produces an oscillatory motion as the eccentric rotates, the oscillatory shaft being attached to the plate and revolving back and forth as the plate oscillates, the brush being oscillated by the back-and-forth rotation of the oscillatory shaft.

5. A power scrubber, which comprises:

a sealed housing;

a motor mounted within the housing having a rotary shaft;

an eccentric rotatably mounted within the housing, which is rotated by the rotary shaft;

an oscillatory shaft pivotally mounted in the housing, the oscillatory shaft extending from the housing and capable of revolving back and forth in an oscillatory manner; and a generally triangular-shaped brush mounted on the oscillatory shaft capable of oscillating pivotally about the revolving oscillatory shaft, the body of the brush having an opening forming a yoke which fits around the eccentric and produces an oscillatory motion as the eccentric rotates, the brush being oscillated pivotally about the oscillatory shaft as the eccentric rotates, the amplitude and speed of the oscillation being determined by the configuration of the yoke.

6. A hand-held power scrubber which comprises: a sealed housing having a configuration for a hand grip;

a rechargeable battery mounted within the housing;

a motor mounted within the housing and connected to receive electric power from the battery;

a switch mounted on the housing and extending therefrom which control the electric power to the motor;

a rotary shaft mounted in the housing, which is driven by the motor;

a reduction gear means mounted on the rotary shaft in the housing for producing a rotary motion at a speed slower than that of the rotary shaft;

an eccentric mounted within the housing to the reduction gear means which is rotated thereby at the slower speed;

a plate mounted within the housing at the bottom thereof, the plate having an opening therein forming a yoke which fits around the eccentric, the plate being oscillated by the rotation of the eccentric within the yoke;

an oscillatory shaft attached to the plate and pivotally mounted in the housing, the oscillatory shaft extending through an opening in the bottom of the housing and alternatingly revolving back and forth as the plate oscillates; and a generally triangular-shaped brush having a body in which is a hole for removably mounting the brush on the oscillatory shaft to be oscillated as the oscillatory shaft revolves back and forth, and having a periphery of outwardly extending angularly disposed bristles mounted on the body about a generally triangular-shaped center set of bristles mounted on the body.

7. A hand-held power scrubber, which comprises:

a sealed housing having a configuration for a hand grip;

a rechargeable battery mounted within the housing;

a motor mounted within the housing and connected to receive electric power from the battery;

a switch mounted on the housing and extending therefrom which controls the electric power to the motor;

a rotary shaft mounted in the housing, which is driven by the motor;

a reduction gear means mounted on the rotary shaft in the housing for producing a rotary motion at a speed slower than that of the rotary shaft;

an eccentric mounted within the housing to the reduction gear means which is rotated thereby at the slower speed;

an oscillatory shaft pivotally mounted in the housing and extending through an opening in the bottom of the housing; and a generally triangular-shaped brush having a body in which is a hole for removably pivotally mounting the brush on the oscillatory shaft, the body also having an opening forming a yoke which fits around the eccentric, the brush being oscillated about the oscillatory shaft axis by the rotation of the eccentric within the yoke, the amplitude and speed of the oscillation being determined by the configuration of the yoke, the body also having a periphery of outwardly extending angularly disposed bristles mounted on the body about a generally triangular-shaped center set of bristles mounted on the body.

* * * * *